United States Patent [19]

Flink

[11] Patent Number: 4,873,799

[45] Date of Patent: Oct. 17, 1989

[54] DAMP-PROOF COMPOSITE FLOORING

[76] Inventor: Attila J. Flink, 29 Waratah St., Rushcutters Bay NSW, Australia, 2011

[21] Appl. No.: 88,630

[22] Filed: Aug. 24, 1987

[51] Int. Cl.[4] ..... E02D 27/00

[52] U.S. Cl. ..... 52/169.8; 52/408

[58] Field of Search ..... 52/169.5, 408

[56] References Cited

U.S. PATENT DOCUMENTS 1,615,350 1/1927 Tambone ..... 52/169.5 X
4,075,799 2/1978 Lemelson ..... 52/169.5
4,298,294 11/1981 Zimmerman ..... 52/169.5 X
4,719,723 2/1988 Van Wagoner ..... 52/408 X

*Primary Examiner*—David A. Scherbel
*Assistant Examiner*—Creighton Smith
*Attorney, Agent, or Firm*—Townsend and Townsend

[57] ABSTRACT

A system of damp-proofing floors and walls of buildings built totally or partially below ground level by constructing a damp-proof composition flooring, and sealing cavity walls. The composite flooring comprising a floor layer above a substantially water impervious layer, a drainage layer and a lower layer. A collection chamber is situated to receive water draining from said walls and said lower layer.

17 Claims, 3 Drawing Sheets

DAMP-PROOF COMPOSITE FLOORING

The present invention relates to flooring and in particular to damp-proof floors.

In constructing a level of a building which is either totally or partially below the level of the surrounding earth a problem has arisen as to how to prevent the dampness of the surrounding earth from penetrating the flooring. This problem also develops, but to a lesser extent, in buildings which are totally above ground.

Accordingly, it is an object of the present invention to ameliorate the above problems.

In one broad form the invention comprises a flooring system comprising a lower surface sloping to at least one side;

- a collection chamber located to receive water from said lower surface;
- a drainage layer located above said lower surface such that water can flow along said lower surface;
- a substantially water impervious layer located above said drainage layer;
- a floor layer being above and in contact with sand substantially water impervious layer; and
- pump means to remove water from sand collection chamber.

In another broad form the invention comprises;

- a flooring system comprising a lower surface sloping to at least one side;
- a collection chamber located to receive water from said lower surface;
- a drainage layer located above said lower surface such that water can flow along said lower surface;
- a substantially water impervious layer located above said drainage layer;
- a floor layer being above and in contact with said substantially water impervious layer;
- pump means to remove water from said collection chamber;
- an outer non water proof wall resting on, or abutting against said lower layer;
- an inner wall resting on, or abutting against said floor layer, and spaced away from said outer non-water proof wall to form a cavity therewith, and spaced above said lower surface; and
- a substantially water impervious layer on the cavity surface of said inner wall.

Preferably, the drainage layer is a cavity, having brick piers to hold the substantially water impervious layer off the sloped lower surface.

The lower surface could be concrete or bedrock formed by suitable means to a substantially smooth surface.

The present invention will now be described by way of example only, with reference to the accompanying drawings in which.

Figure 1:
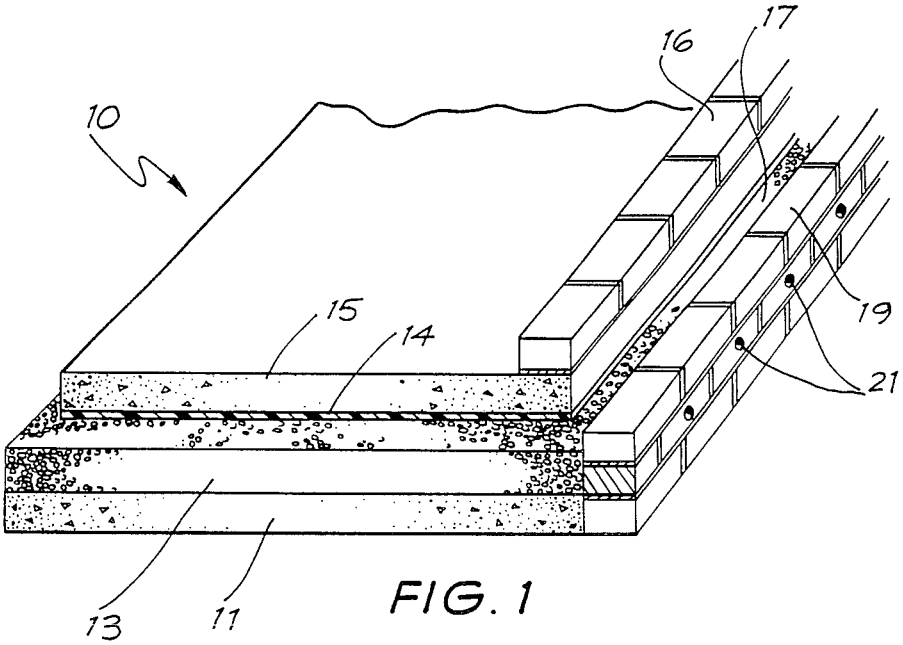
FIG. 1 is a perspective view of a floor according to one embodiment of the present invention.
Figure 3:
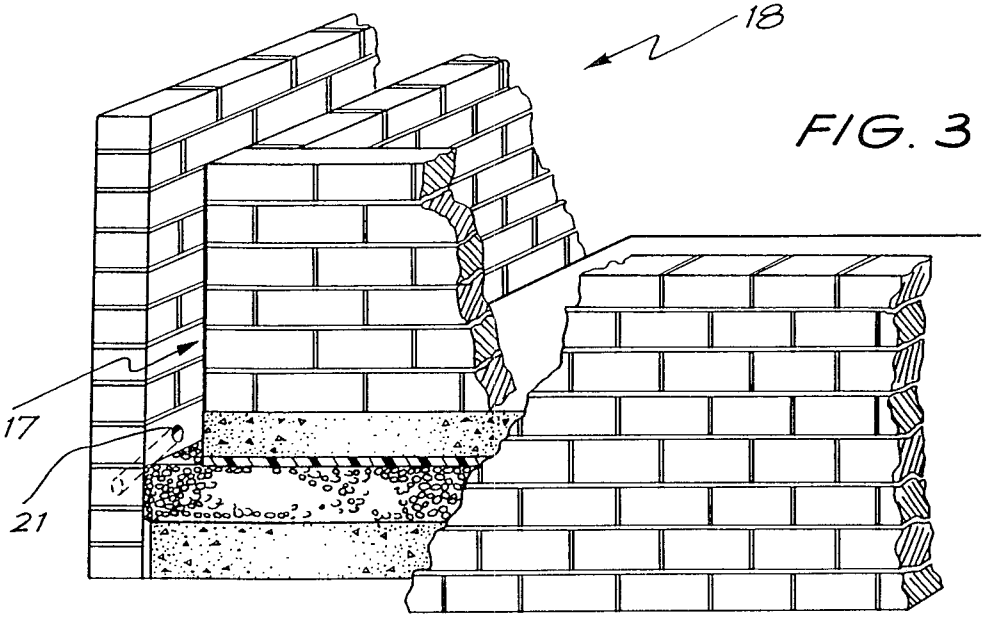
FIG. 3 is a part perspective view of a room constructed with the composite flooring of the present invention utilizing the embodiment of FIG. 1.

In FIG. 1 there is shown a damp-proof composite flooring system 10. First, a bottom concrete layer 11 is placed on the ground, this bottom layer 11, being of a preselected thickness, may be laid directly on the ground or within the boundary of existing walls 19. On top of the layer 11 is placed a layer of gravel 13, of a required thickness and of suitable large sized particles to allow for drainage therethrough. The next layer, which is immediately above the gravel 13, is a non-porous layer 14, then on top of the non-porous layer 14 is a non-perishable membrane such a polythene, asbestos etc. The floor 15 of concrete is poured on top of the non-porous layer 14, leaving a cavity 17 between the walls and the layer 15 which allows the water to flow to the bottom layer 11, this being shown in FIG. 3.

The bottom layer 11 has its top surface so shaped as to define a slope which terminates at a pit or collection chamber (not shown). Water that has entered the flooring system 10, by the walls or any other means, collects within the pit. In communication with the pit is a pumping means (not shown) which discharges the collected water from the flooring system 10. If excessive water deposits occur within the pit, then additional pumping means may be used as required.

Figure 2:
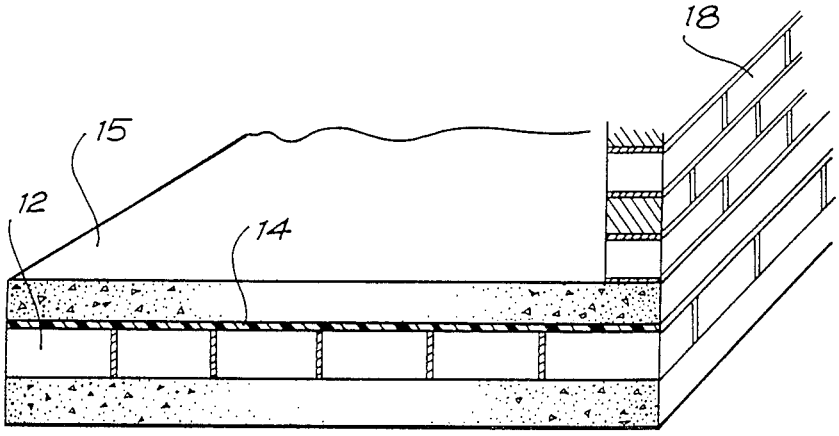
FIG. 2 is also a perspective view of another embodiment of the present invention.

FIG. 2 illustrates a further embodiment showing only the inner wall wherein the layer of gravel is replaced by brick piers 12 constructed of any required height (and not just limited to a single brick height as shown,) thereby providing a cavity 24 for the drainage layer. The spacing between the brick or brick piers would be determined by the floor load or rate of water intrusion.

Figure 4:
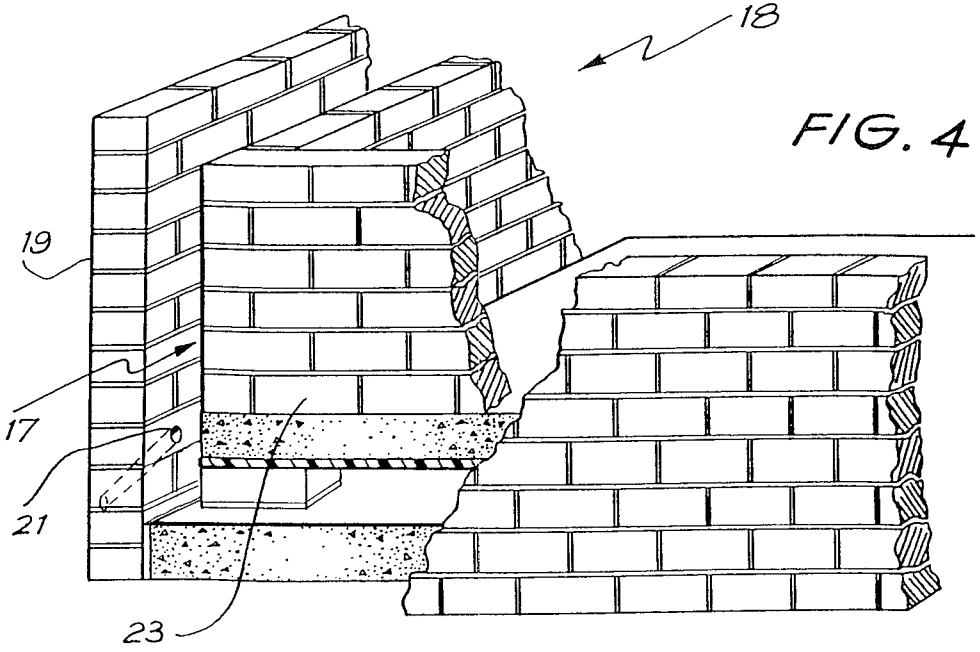
FIG. 4 is view similar to FIG. 3 but utilizing the embodiment of FIG. 2

As shown in FIG. 4 the outer wall 19 is separated from the inner wall 18 to form a cavity 17. A water proof coating 22 as shown in FIG. 2 can be applied to the cavity face of the wall 18.

Further the bottom layer 23 of bricks of the inner wall 18 could be impregnated with a suitable water proofing composition.

To facilitate removal of water from the cavities 17, 13 and 24 drainage holes 21 pass through the outer wall 19 preferably at an angle of 55°.

Preferably the surface of the layer 11 should be smooth so as to prevent water from sitting pockets on the layer 11.

In some circustances the cavity 17 could be filled with under pressure by a liquid settable waterproof material which can permiate the inner and outer brick walls.

It should be obvious to people skilled in the art that modification and alterations can be made to the above described flooring system without departing from the spirit or scope of the present invention.

I claim:

1. A flooring system comprising:

- a lower surface sloping to at least one side;
- a collection chamber, situated to receive water from said lower surface;
- a drainage layer, comprising bricks or brick piers, situated above said lower surface such that water can flow along said lower surface;
- a substantially water impervious layer, disposed above said drainage layer;
- said drainage layer defining a cavity between said lower surface and said substantially water impervious layer;
- a floor layer, disposed above and in contact with said substantially water impervious layer; and
- pump means for removing water from said collection chamber.

2. A flooring system according to claim 1, further indicating:

an outer, non-water proof, wall contacting said lower surface;

an inner wall, contacting said floor layer, spaced apart from said outer, non-water proof, wall to form an inter-wall cavity therebetween, and spaced above said lower surface; and a substantially water impervious layer on a cavity surface of said inner wall.

3. A flooring system according to claim 2, wherein said inner wall rests on said floor layer.

4. A flooring system according to claim 2, wherein said inner wall abuts said floor layer.

5. A flooring system according to claim 2, wherein said outer, non-water proof wall, abuts said lower surface.

6. A flooring system according to claim 2, wherein a lower-most portion of said inter-wall cavity communicates with said drainage layer.

7. A flooring system according to claim 2, wherein said outer, non-water proof, wall defines a drain hole permitting fluid communication from the inter-wall cavity to external of said outer, non-water proof, wall.

8. A flooring system according to claim 7, wherein said drain hole slopes downward about 55° from the inter-wall cavity to external of said outer non-water proof wall.

9. A flooring system comprising:

a lower surface;

a collection chamber, situated to receive water from said lower surface;

a drainage layer, situated above said lower surface such that water can flow along said lower surface;

a substantially water impervious layer, disposed above said drainage layer;

said drainage layer including bricks or brick piers defining a cavity between said substantially water impervious layer and said lower surface;

a floor layer, disposed above and in contact with said substantially water impervious layer; and pump means for removing water from said collection chamber.

10. A flooring system according to claim 9, wherein said lower surface slopes to at least one side.

11. A flooring system comprising:

a lower surface;

a collection chamber, situated to receive water from said lower surface;

a drainage layer, situated above said lower surface such that water can flow along said lower surface;

a substantially water impervious layer, disposed above said drainage layer;

a floor layer, disposed above and in contact with said substantially water impervious layer;

pump means for removing water from said collection chamber;

an outer wall, abutting against said lower surface;

an inner wall, resting on said floor layer, spaced apart from said outer wall to form an inter-wall cavity therebetween, and spaced above said lower surface; and a substantially water impervious layer on an inter-wall cavity surface of said inner wall.

12. A flooring system according to claim 11, wherein said lower surface slopes to at least one side.

13. A flooring system according to claim 11, wherein said drainage layer includes gravel.

14. A flooring system according to claim 11, wherein said drainage layer includes bricks or brick piers defining a cavity between said substantially water impervious layer and said lower surface.

15. A flooring system according to claim 11, wherein said outer wall defines a drain hole permitting fluid communication from the inter-wall cavity to external of said outer wall.

16. A flooring system according to claim 15, wherein said drain hole slopes downward about 55° from the inter-wall cavity to external of said outer wall.

17. A flooring system according to claim 11, wherein a lower-most portion of said inter-wall cavity communicates with said drainage layer.

* * * * *